US008899785B2

(12) United States Patent
Van de Ven

(10) Patent No.: US 8,899,785 B2
(45) Date of Patent: Dec. 2, 2014

(54) LAMP WITH MULTI-COLORED LEDS AND METHOD OF MAKING

(75) Inventor: Antony Paul Van de Ven, Hong Kong (CN)

(73) Assignee: Cree, Inc., Durham, NC (US)

( * ) Notice: Subject to any disclaimer, the term of this patent is extended or adjusted under 35 U.S.C. 154(b) by 347 days.

(21) Appl. No.: 13/183,067

(22) Filed: Jul. 14, 2011

(65) Prior Publication Data

US 2013/0016509 A1 Jan. 17, 2013

(51) Int. Cl.
*F21V 21/002* (2006.01)
*F21V 7/00* (2006.01)

(52) U.S. Cl.
CPC ..... *F21V 7/00* (2013.01)
USPC ..... 362/241; 362/231; 362/243; 362/245; 362/249.02; 362/294

(58) Field of Classification Search
USPC ..... 362/650, 231, 240, 241, 243, 245, 246, 362/249.02, 294
See application file for complete search history.

(56) References Cited

U.S. PATENT DOCUMENTS

| | | | | |
|---|---|---|---|---|
| 1,683,599 | A * | 9/1928 | Berry | 362/311.09 |
| 3,590,241 | A * | 6/1971 | Docimo et al. | 362/355 |
| 5,420,482 | A * | 5/1995 | Phares | 315/292 |
| 5,575,459 | A * | 11/1996 | Anderson | 362/240 |
| 6,019,493 | A * | 2/2000 | Kuo et al. | 362/335 |
| 6,981,784 | B2 * | 1/2006 | Dubuc | 362/331 |
| 7,588,351 | B2 * | 9/2009 | Meyer | 362/294 |
| 7,758,223 | B2 * | 7/2010 | Osawa et al. | 362/547 |
| 8,272,766 | B2 * | 9/2012 | Phipps et al. | 362/294 |
| 8,398,266 | B2 * | 3/2013 | Wang | 362/249.02 |
| 2008/0112170 | A1 * | 5/2008 | Trott et al. | 362/311 |
| 2008/0130298 | A1 * | 6/2008 | Negley et al. | 362/365 |
| 2010/0026157 | A1 * | 2/2010 | Tanaka et al. | 313/45 |
| 2010/0219735 | A1 * | 9/2010 | Sakai et al. | 313/46 |

* cited by examiner

*Primary Examiner* — Ismael Negron
(74) *Attorney, Agent, or Firm* — Dennis J. Williamson; Moore & Van Allen PLLC

(57) ABSTRACT

A lamp including an LED assembly having at least a first LED to emit light of at least a first color, and at least a second LED to emit light of at least a second color. The first and second LEDs received in an enclosure having a reflective internal surface, the enclosure configured to mix the light emitted from the LEDs, with the mixed light emitted from the lamp through a diffuser lens. A trim piece, formed at least partially of a thermally conductive material, may be secured to the lamp. A method of making the lamp is also provided.

35 Claims, 7 Drawing Sheets

LAMP WITH MULTI-COLORED LEDS AND METHOD OF MAKING

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, and contain no lead or mercury. In many applications, one or more LED dies or chips are mounted within an LED package or on an LED module, which may make up part of a lighting unit, lamp, or bulb. The lighting system typically also includes one or more power supplies to power the LEDs.

SUMMARY

A lamp comprises an LED assembly comprising at least a first LED operable to emit light at least of a first color, and at least a second LED operable to emit light at least of a second color. An enclosure is configured so that the light emitted from the first LED is mixed with the light emitted from the second LED in the enclosure. The enclosure has an internal reflector wall. The light is emitted from the lamp through a diffuser lens.

The enclosure may form part of a heat sink for the LEDs. The internal reflector wall may comprise a plurality of flat faces. A power supply for powering the LED assembly may be provided. A heat spreader may be disposed between the LED assembly and the power supply. A diffuser dome may be provided in the enclosure for diffusing the light from the LED assembly as it enters the enclosure. The internal reflector wall may comprise a substantially parabaloid shape. The first LED may emit blue light. The LED may be packaged in a module to form a blue shifted LED such as a blue-shifted yellow LED. The second LED may emit red, orange or red/orange light.

The enclosure may comprise an aluminum spun housing. The internal reflector wall may be provided with high reflective paint. A trim piece may be secured to the lamp. The trim piece may be formed at least partially of a thermally conductive material. The trim piece may define a receptacle that receives a distal end of the lamp and at least one locking member that engages the lamp such that the trim piece is secured the lamp. The locking member may be moved between a retracted position where the lamp may be inserted into the receptacle and an extended position where the locking member holds the lamp to the trim piece. The lamp may include a clip formed integrally with the lamp where the clip engages the trim piece such that the trim piece is secured the lamp. The trim piece may comprise a diffuser lens.

A method of making an LED lamp comprises providing at least a first LED operable to emit light of a first color and at least a second LED operable to emit light of a second color; packaging the first LED and the second LED to produce an LED assembly that emits light of the first color and the second color that can be combined to provide light; connecting the LED assembly to a power supply; and installing a color mixing enclosure with an internal reflector wall and a diffuser lens configured so that at least some light emitted by the LED assembly when the first LED and the second LED are energized is mixed in the mixing enclosure and exits the LED lamp from the color mixing enclosure through the diffuser lens. The method may comprise installing the power supply in an enclosure that enables the LED lamp to replace a standard incandescent bulb. The method may further comprise securing a trim piece to the lamp to make a complete lamp assembly.

A lamp comprises a LED assembly comprising at least a first LED operable to emit light of at least a first color. An enclosure has an internal reflector wall and a diffuser lens through which the light is emitted from the lamp. A trim piece comprises a first opening secured to the enclosure to form an integral lamp assembly where at least some of the light emitted from the lamp passes through the first opening.

The lamp assembly may comprise a plurality of clips spaced about the periphery of the distal end of the lamp that engage mating receptacles formed in the trim piece. The clips may resiliently deform to engage the receptacles. The clips may be formed as part of a separate clamping ring. The clamping ring may retain the diffuser lens on the housing. The trim piece may comprise a parabaloid dome having a second opening dimensioned to receive the distal end of lamp. The trim piece maybe made at least in part of a thermally conductive material. The trim piece may be provided with a plurality of locking members, the locking members engaging the lamp to secure the lamp to the trim piece. The locking members may be deformable or resilient. The trim piece may be provided with mounting clips that are pivotably mounted to the trim piece such that the mounting clips may be rotated to engage the back of a wall or ceiling.

DETAILED DESCRIPTION

The following detailed description refers to the accompanying drawings, which illustrate specific embodiments of the invention. Other embodiments having different structures and operation do not depart from the scope of the present invention. Like reference numbers refer to like structures throughout. It should be noted that the drawings are schematic in nature. Not all parts are always shown to scale.

Figure 2:
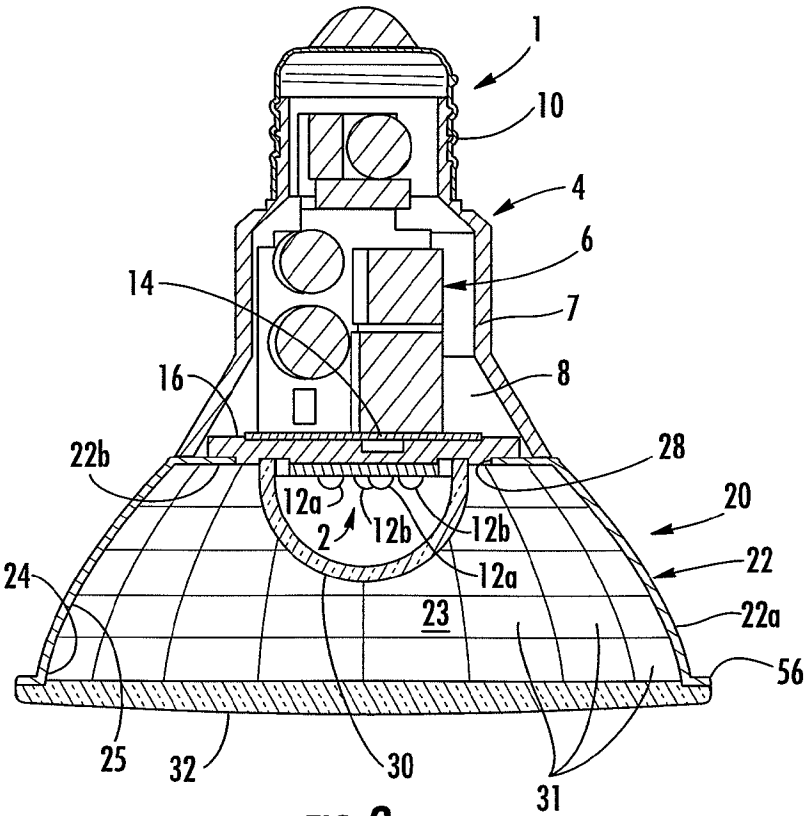
FIG. 2 is a section view of the lamp of FIG. 1 taken along line 2-2 of FIG. 1.
Figure 1:
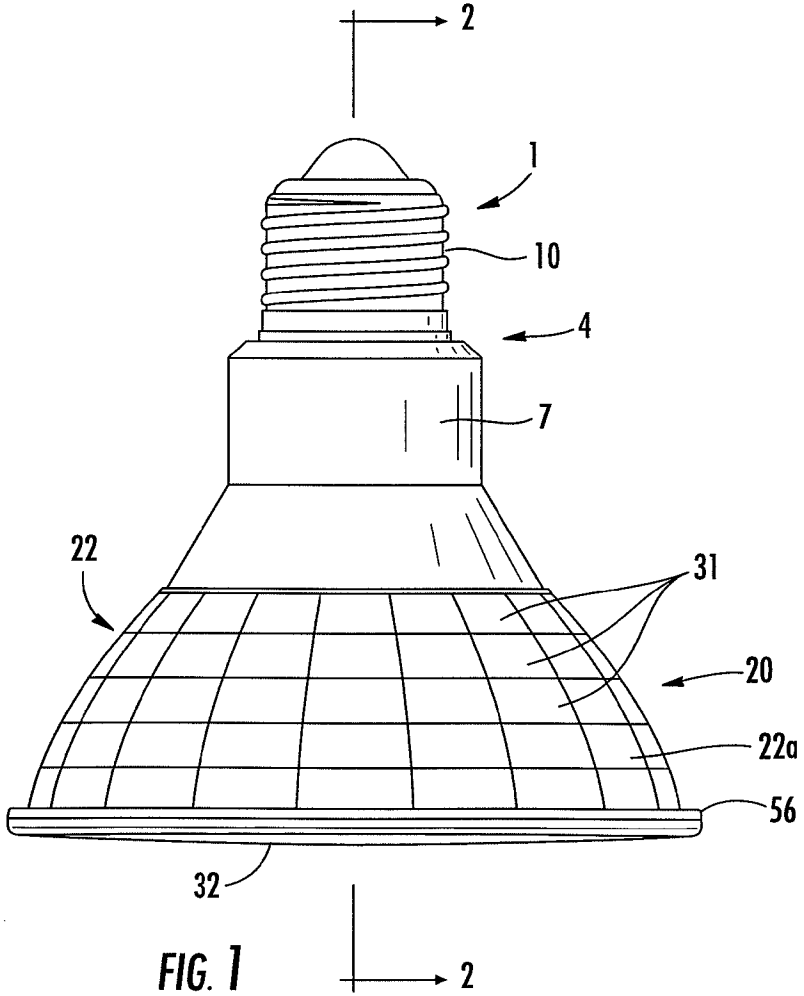
FIG. 1 is a plan view of an embodiment of the lamp of the invention.
Figure 3:
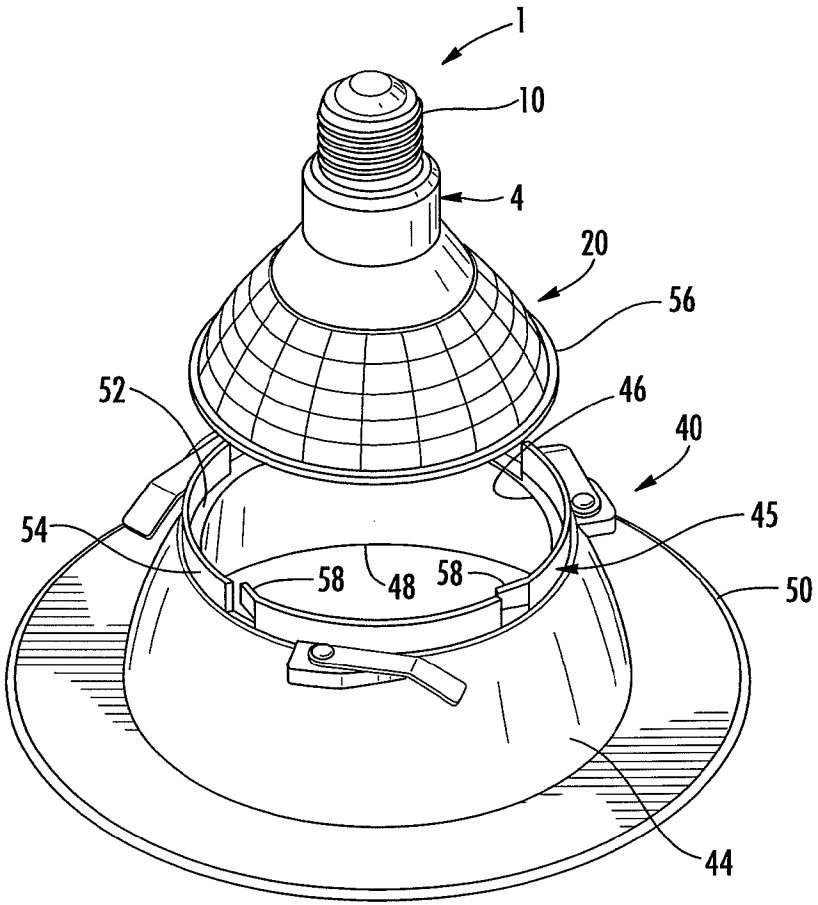
FIG. 3 is a perspective view of the lamp of FIG. 1 and a trim piece in a disassembled condition.

Referring to FIGS. 1 through 3, an embodiment of a lighting unit, lamp, light bulb or bulb (hereinafter referred to as "lamp") is shown. LED assembly 2 of the lamp 1 is shown interconnected with power supply portion 4 of the lamp. The power supply portion 4 of the lamp comprises a plastic housing 7 in which is located power supply circuitry 6 to provide DC current to the LED assembly 2. To assemble the power supply portion 4 of the lamp 1, the power supply circuitry 6 is installed within the void 8 in the housing 7 and is potted, or covered, with an epoxy or resin to provide mechanical and thermal stability. The potting material fills the void 8 within housing 7 not occupied by power supply circuitry 6 and connecting wires.

The particular power supply portion 4 of the embodiment of the LED lamp 1 shown in FIG. 1 includes an Edison base 10 and the lamp 1 may be shaped and size to act as a replacement for a standard bulb. The Edison base 10 can engage with an Edison socket so that this example LED lamp can replace a standard incandescent bulb. The electrical terminals of the Edison base are connected to the power supply circuitry 6 to provide AC power to the power supply. The particular physical appearance of the power supply portion 4 and base 10 are examples only. Numerous types of LED lamps can be created using embodiments of the invention, with various types of bases, power supply portions and shapes.

LED assembly 2 further includes multiple LED modules 12*a*, 12*b* mounted on a carrier such as circuit board 14, which provides both mechanical support and electrical connections for the LED modules. The LED modules 12*a*, 12*b* comprise an LED chip or die that is encapsulated inside a package with a lens and leads that connect to power supply circuitry 6 for providing power to the chip or die. The circuit board 14 may be a printed circuit board with thermal vias. The LED assembly 2 may be held in place with screws or other mechanism that secure the LED assembly 2 onto heat spreader 16. The heat spreader 16 may comprise a 3 mm thick aluminum heat spreader. Voids may be provided in the heat spreader 16 to allow wires from the power supply circuitry 6 to be connected to the LED assembly 2. A thermal isolation device may be located between the LED assembly 2 and the power supply portion 4 to keep heat from the LED assembly 2 from excessively raising the temperature of the power supply components.

LED assembly 2 in this example embodiment includes multiple LED modules 12*a*, 12*b*, in which an LED chip is encapsulated inside a package with a lens and leads. Each LED module is mounted in circuit board 14. The LED modules 12*a*, 12*b* comprise different types of LEDs and include LEDs operable to emit light of two different colors. In this example embodiment, the LED modules 12*a* on the LED assembly 2 in the lamp of FIG. 1 comprise blue LEDs, wherein each LED, when illuminated, emits light having peak wavelength from 430 nm to 490 nm. The LED modules 12*b* on the LED assembly 2 in the lamp of FIG. 1 comprise red LEDs, wherein each LED, when illuminated, emits red, orange or red/orange light having a dominant wavelength from 600 nm to 645 nm. In some embodiments LEDs of one type are packaged with a lumiphor. A lumiphor is a substance, which, when energized by impinging energy, emits light. Phosphor is an example of a lumiphor. In some cases, phosphor is designed to emit light of one wavelength when energized by being struck by light of a different wavelength, and so provides wavelength conversion. In the present example embodiment, the blue LEDs in LED modules 12*a* in LED assembly 2 are packaged with a yellow or green or orange phosphor or mixture of phosphors which, when excited by light from the included LED, emits light having a dominant wavelength from 530 nm to 590 nm. In this example, the phosphor is deposited on the encapsulating lens for each LED at such a thickness so that some of the light from the LED goes through the phosphor, while other light is absorbed and the wavelength is converted by the phosphor.

Thus, each LED is packaged in modules 12*a* forms a blue-shifted yellow (BSY) LED device, while the light from each LED packaged in modules 12*b* passes out of the LED module as red or orange or red/orange (R) light. Substantially white light can be produced when the two colors of light from the modules 12*a*, 12*b* in the LED assembly 2 are combined. Thus, this type of LED assembly may be referred to as a BSY+R LED assembly and produces white light with a high color rendering index (CRI). In addition to a BSY+R LED assembly the LED assembly may comprise a blue shifted LED device such as a blue shifted green (BSG) LED device or blue shifted red (BSR) LED device mixed with another color to produce emitted light of a suitable color such as white. The device may also use a phosphor globe excited by a combination of blue, red and BSY LED devices.

It should be noted that other arrangements of LEDs can be used with embodiments of the present invention. For example, a UV LED coated with red/blue/green phosphor; red/green/blue LED's with no phoshors; blue/blue-yellow LEDs and others may be used. The same or varying numbers of each type of LED can be used, and the LED packages can be arranged in varying patterns. A single LED or multiple LEDs of each type could be used. Additional LEDs, which produce additional colors of light, can be used. Lumiphors can be used with some or all the LED modules. Multiple LED chips may be included in one, some or all of the LED modules. A further detailed example of using groups of LEDs emitting light of different wavelengths to produce substantially white light can be found in issued U.S. Pat. No. 7,213,940, which is incorporated herein by reference in its entirety.

The lamp 1 further comprises a color mixing enclosure 20 defined in part by housing 22. In this particular embodiment, enclosure 20 provides color mixing so that color hot spots do not appear in the light pattern being emitted from the lamp and the light emitted from the lamp is a uniform white light. The housing 22 also acts as a heat sink such that an additional heat sink structure is not required. In the embodiment of the lamp illustrated in the figures, the enclosure 20 is formed as a parabolic aluminized reflector that generates a directional wide light pattern. The lamp may be used as a replacement for lights such as spot lights and flood lights as are commonly found in lighting applications such as recessed lights and may be used as a replacement for existing PAR.

The housing 22 may comprise an aluminum spun housing having an interior space 23 defined by an internal reflector wall 25 that has a generally circular parabaloid shape. The internal reflector wall 25 is formed on the inside of a side wall 22*a* and terminates in a wide opening or mouth 24 through which light is emitted from the lamp. The housing 22 may be provided in any suitable width including widths suitable for use as replacement lights for standard PAR lights, flood lights, spot lights and the like. A base wall 22*b* extends inwardly from the end of the side wall 22*a* opposite to opening or mouth 24. The base wall 22*b* comprises a centrally disposed aperture 28 through which the LED assembly 2 extends such that light emitted from the LED assembly 2 enters the space 23 defined by enclosure 20. The LED assembly 2 is covered by a diffuser dome 30 such that light emitted from the LED assembly 2 is diffused such that the emitted light is spread over the internal reflector wall 25 of housing 22. The internal reflector wall 25 of housing 22 may be provided with high reflective paint to reflect the light back into the color mixing enclosure such that the light is mixed prior to being emitted from the lamp to prevent color hot spots and to provide a uniform light from the lamp. The internal reflector wall 25 may be formed of a plurality of flat or substantially flat surfaces 31 that approximate the circular parabaloid shape such that the light is reflected at varying angles back into the mixing enclosure such that complete mixing of the light is provided. In the illustrated embodiment the side wall 22*a* has a thin-walled construction such that the exterior of housing 22 also has a circular paraboloid shape defined by flat surfaces 31 that corresponds to the shape of the internal reflector wall 25, although the exterior of housing 22 may have other shapes. A diffuser lens 32 covers the opening 24 such that the light emitted from the lamp is diffused upon exiting the lamp to create a wide light pattern. The diffuser lens 32 may be attached to the housing by heat resistant epoxy, mechanical fastener or the like. The lamp 1 is a directional lamp that emits the light in a direction such that it may be used as a spot light, flood light or the like.

The base wall 22*b* of housing 22 is in heat conductive contact with the heat spreader 16 such that heat generated by the LED assembly 2 is conducted from the heat spreader 16 to the housing 22 where the heat is dissipated from the lamp to the ambient environment. The housing 22 may also be in direct contact with LED assembly 2. Because the housing 22 is made of thermally conductive material, such as aluminum, the housing 22 may act as a heat sink eliminating the need for a separate heat sink assembly in the lamp. In the illustrated embodiment the entire housing is made of thermally conductive material; however, portions of the housing may be made of other types of material provided that the housing functions to dissipate heat from the LED assembly 2. Because a separate heat sink may be eliminated the housing 22 may be connected directly to the power supply section 4.

Figure 4:
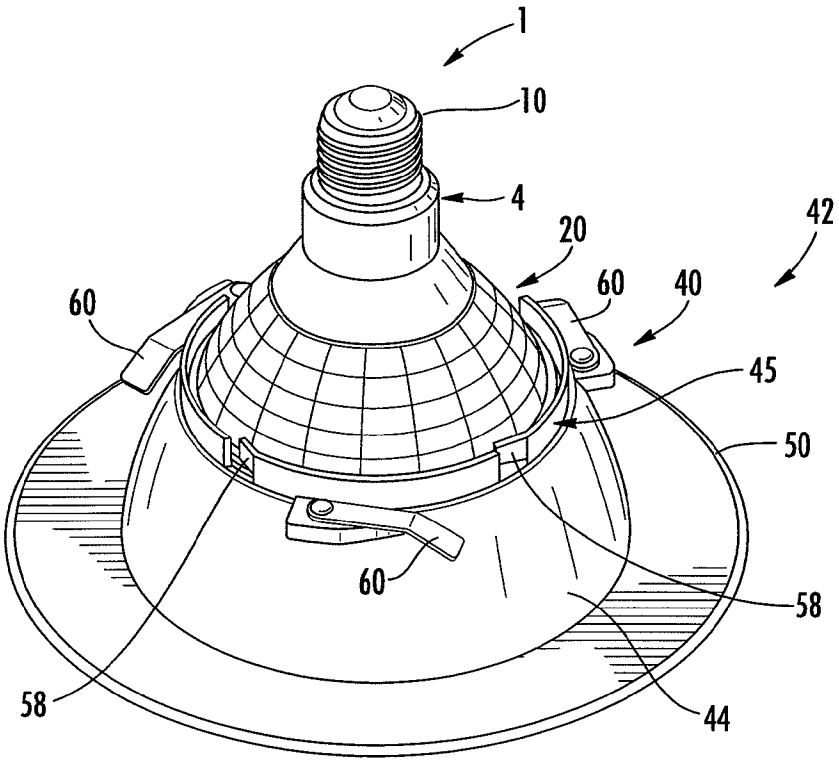
FIG. 4 is a plan view of the lamp of FIG. 1 and the trim piece in an assembled condition.

Referring to FIGS. 3 and 4 a plastic trim piece 40 may be attached to the lamp 1 to create an integral lamp assembly 42 for use in a recessed light application such as retrofitting an existing light opening. The trim piece 40 may be made of plastic, metal or a combination of materials. If the trim piece 40 is made of all-metal, or other thermally conductive material, or if the trim piece is made of metal, or other thermally conductive material, in those areas that contact and are adjacent to housing 22, the trim piece 40 may also act as an additional heat sink for the LEDs. The areas in direct contact with the housing 22 may be made of metal, or other heat conductive material, to dissipate heat from the lamp if desired. While the trim piece 40 may be made of a thermally conductive material, because the lamp 1 does not get extremely hot, an all-plastic trim piece may be used if desired.

In one embodiment, the trim piece 40 comprises a parabaloid dome 44 having an opening 46 on its top end dimensioned to receive the distal end of lamp 1 and an opening 48 on its bottom end through which light from the lamp 1 is emitted. As explained above the dome may be made of a thermally conductive material such as metal to conduct heat away from the lamp 1. An annular flange 50 is connected to the bottom edge of the dome 44. The dome 44 is dimensioned to fit into an opening in a ceiling or other structure such that the flange 50 abuts the ceiling or other structure to close the opening and provide an aesthetically pleasing finish.

In one embodiment a receptacle 45 for receiving the distal end of the lamp is disposed adjacent opening 46 where the receptacle is defined by an annular lip 52 that surrounds the opening 46 and an upstanding annular wall 54 that surrounds the lip 52. The lip 52 has an internal dimension that is slightly smaller than the diameter of the color mixing enclosure 20 and diffuser lens 32 at the distal end of the lamp such that a peripheral rim 56 (see FIGS. 1 and 2) of the lamp abuts against the lip 52. The wall 54 closely surrounds the distal end of lamp 1 and rim 56 when the lamp is in abutting relationship with the lip 52. The receptacle 45 is provided with a plurality of locking members 58 spaced about the periphery of the receptacle 45. Locking members 58 may be moved over rim 56 or other structure formed about the periphery of the lamp such that the rim 56 is trapped between the lip 52 and the locking members 58 to secure the lamp 1 to the trim piece 40. The locking members 58 may be made of a deformable material such as steel that may be moved between a retracted position where the lamp 1 may be inserted into the receptacle 45 and an extended position where the locking members extend over the rim 56 to hold the lamp 1 to the trim piece 40 (FIG. 4). Alternatively, the locking members 58 may be resilient, or may be resiliently connected to the wall 54 such as by a spring hinge such that when the rim 56 of lamp 1 is inserted past wall 54, the locking members 58 deform to a retracted position allow the lamp to enter into the receptacle 45 and then return to the extended position to secure the lamp 1 to the trim piece 40 (FIG. 4). The areas in direct contact with the lamp 1 including the locking members 58 and receptacle 45 may be made of metal, or other heat conductive material, to dissipate heat from the lamp if desired. The trim piece 40 may be provided with mounting clips 60 that are pivotably mounted to the trim piece such that the clips 60 may be rotated from the illustrated retracted position to an extended position to engage the back of a wall or ceiling, for example, to hold the lamp and the trim piece in the ceiling or wall.

Figure 5:
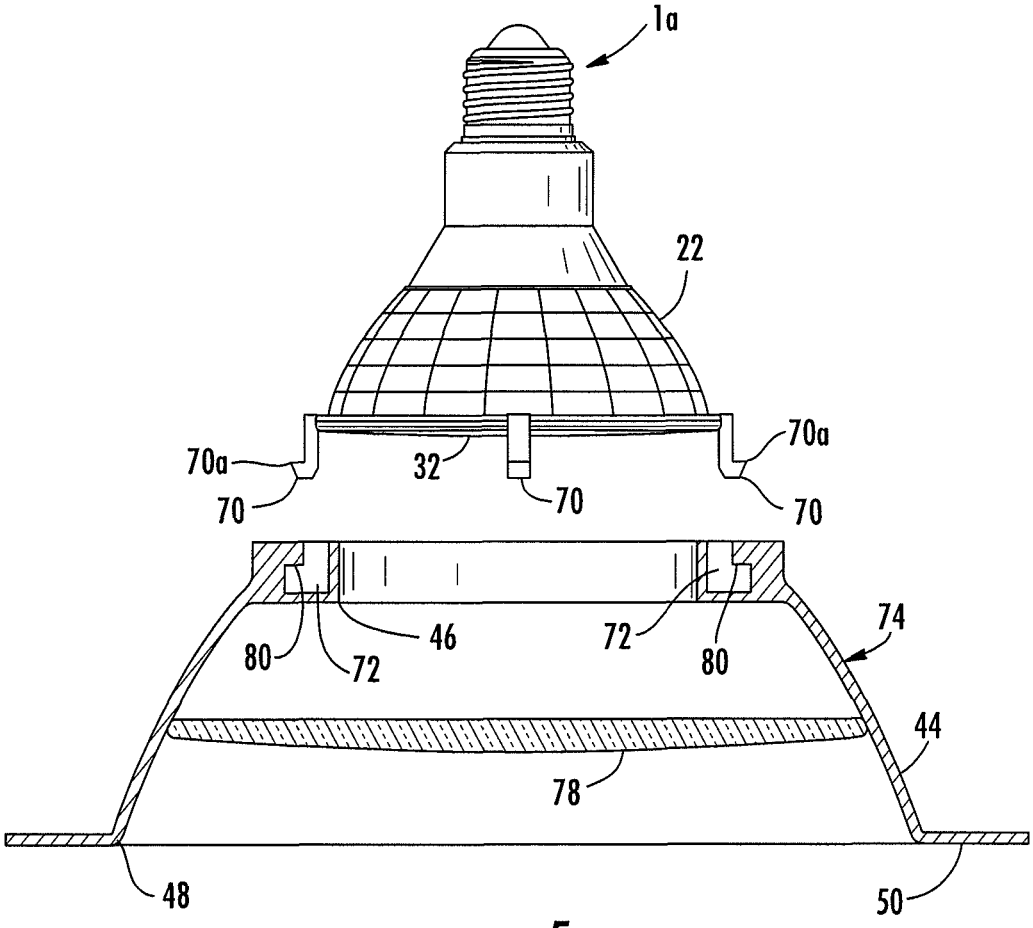
FIG. 5 is a section view of the lamp of FIG. 1 and a section view of another embodiment of the trim piece.
Figure 6:
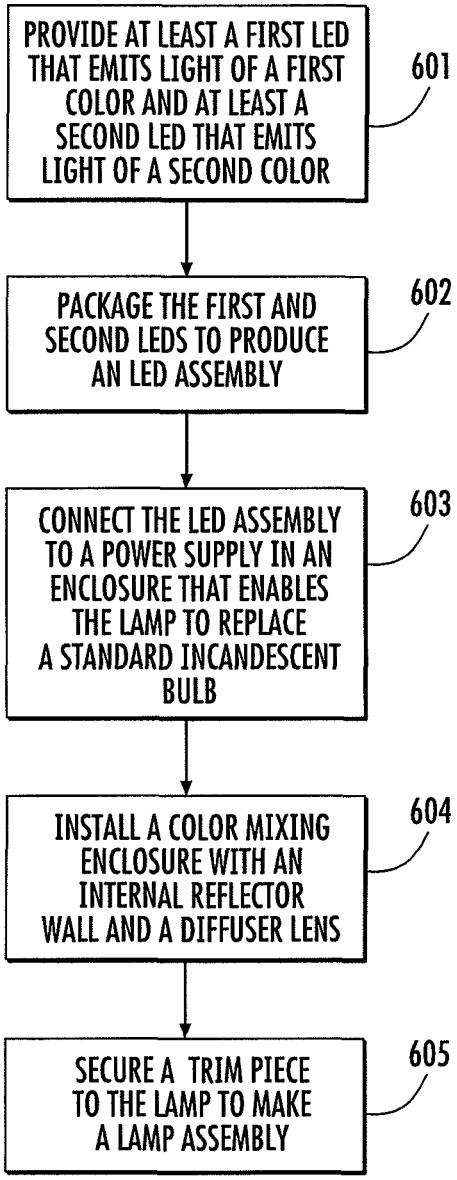
FIG. 6 is a block diagram illustrating an embodiment of a method of making the lamp of the invention.
Figure 7:
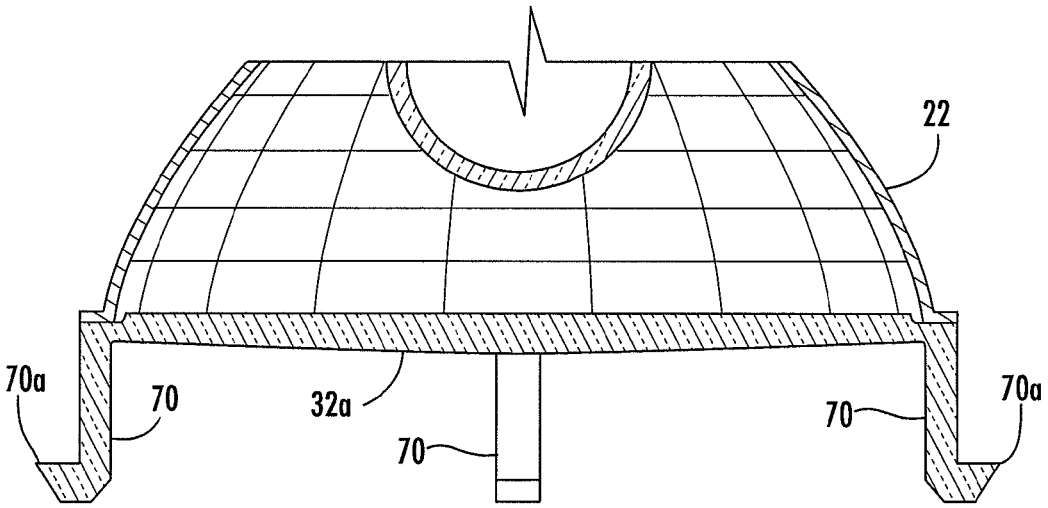
FIGS. 7, 8 and 9 are partial section views of the lamp illustrating alternate embodiments of the clips for attaching the lamp to the trim piece.
Figure 8:
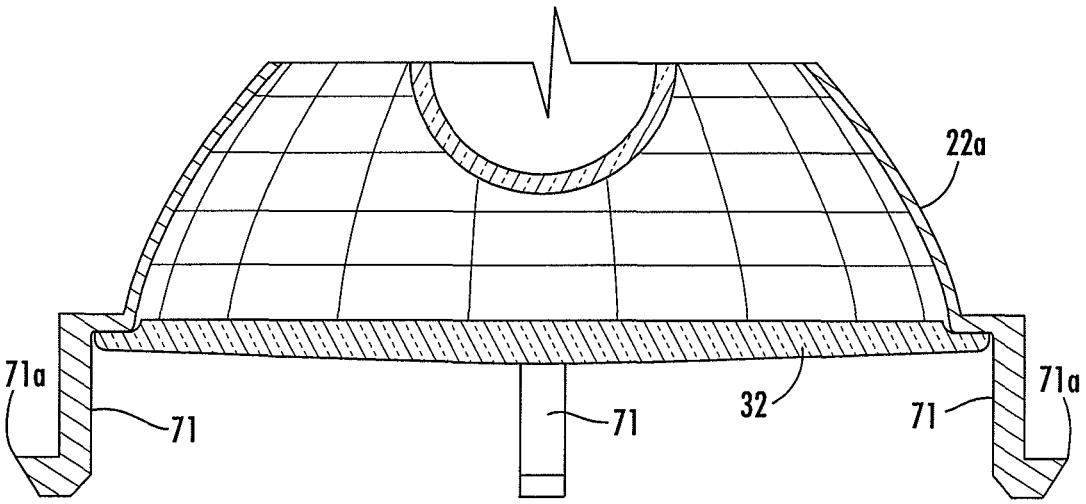
Figure 9:
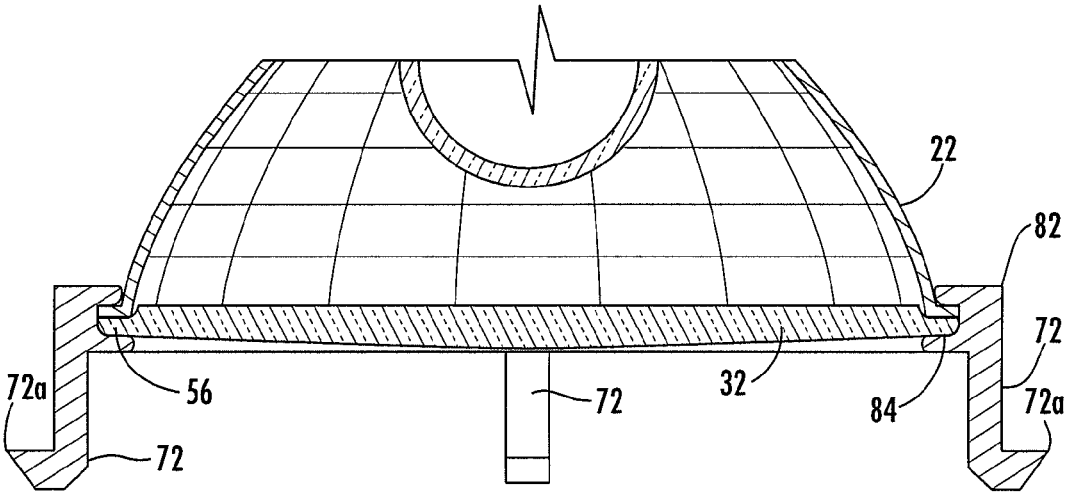

An alternative embodiment for securing the lamp and the trim piece is shown in FIG. 5. The lamp 1*a* is provided with a plurality of clips 70 spaced about the periphery of the distal end of the lamp 1 that engage mating receptacles 72 formed in the trim piece 74 where the clips 70 resiliently deform to engage the receptacles 72. The receptacles may be formed as recesses or apertures in the trim piece 74. In one embodiment the clips 70 may be formed integrally with the diffuser lens 32*a* as shown in FIG. 7 or clips 71 may be formed integrally with the housing 22*a* as shown in FIG. 8. The clips may be formed as a single piece with the housing or diffuser lens, as shown, or he clips may be separately secured to these elements. The clips 72 may also be formed as part of a separate ring 82 as shown in FIG. 9 where the ring is separate piece attached to the distal end of the lamp. The ring 82 may comprise an annular ring that is disposed about the periphery of the lamp and that receives a rim 56 of the ramp in an annular groove 82. The ring 82 may be used to retain the diffuser lens 32 on the housing 22. The ring 82 may deform to snap onto the housing 22 and diffuser lens 32, it may be attached using adhesive or separate mechanical fasteners or it may comprise a clamping ring that may be disposed over the housing 22 and the diffuser lens 32 and be tightened against these elements.

The clips 70, 71 and 72 may comprise resilient fingers that extend from the lamp and that may resiliently deform to engage the receptacles 72. The clips 70 are inserted into the receptacles 72 formed on the trim piece such that the clips 70 deform to engage the trim piece to hold the trim piece on the lamp using a "snap-fit" connection. The clips are provided with protuberances 70*a* , 71*a* and 72*a* that engage portions 80 of receptacles 72 to lock the trim piece 74 to the lamp 1. The areas in direct contact with the lamp including the clips 70 and receptacles 72 may be made of metal, or other heat conductive material, to dissipate heat from the lamp if desired. The trim piece 74 may also be provided with a separate diffuser lens 78 where the diffuser lens is separate from the lamp. The diffuser lens 32 may be eliminated if the diffuser lens 78 is used. The trim piece 74 may also be secured to the lamp to form an integral lamp assembly using springs, glue, thread tape, thermal gap filler or the like.

A method of making an LED lamp comprises providing at least a first LED operable to emit light of a first color and at least a second LED operable to emit light of a second color as described herein (Block 601). The first LED and the second LED are packaged to produce an LED assembly that emits light of the first color and the second color that can be combined to provide white light as previously described (Block 602). The LED assembly is connected to a power supply where the power supply may be in an enclosure that enables the LED lamp to replace a standard incandescent bulb as previously shown (Block 603). A color mixing enclosure with an internal reflector wall and a diffuser lens is installed with the LED assembly and is configured so that at least some light emitted by the LED assembly when the first LED and the second LED are energized is mixed in the mixing enclosure and exits the LED lamp from the color mixing enclosure through the diffuser lens (Block 604). The mixing enclosure may comprise an internal reflector wall in the shape of a circular parabaloid dome as previously described. A trim piece may be secured to the lamp as shown and described to make a complete lamp assembly (Block 605).

The terminology used herein is for the purpose of describing particular embodiments only and is not intended to be limiting of the invention. As used herein, the singular forms "a", "an" and "the" are intended to include the plural forms as well, unless the context clearly indicates otherwise. It should also be pointed out that references may be made throughout this disclosure to figures and descriptions using terms such as "above", "top", "bottom", "side", "within", "on ", and other terms which imply a relative position of a structure, portion or view. These terms are used merely for convenience and refer only to the relative position of features as shown from the perspective of the reader. An element that is placed or disposed atop another element in the context of this disclosure can be functionally in the same place in an actual product but be beside or below the other element relative to an observer due to the orientation of a device or equipment. Any discussions which use these terms are meant to encompass various possibilities for orientation and placement.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

a LED assembly comprising at least a first LED operable to emit light of at least a first color;

an enclosure having an internal reflector wall and a diffuser lens through which the light is emitted from the lamp;

a trim piece comprising a first opening secured to the enclosure to form an integral lamp assembly where at least some of the light emitted from the lamp passes through the first opening;

and a base comprising an electrical connector coupled to the enclosure and configured to be connected to a socket where the electrical connector is exposed when the trim piece is secured to the enclosure such that the lamp may be connected to a separate source of power.

2. The lamp assembly of claim 1 where the trim piece comprises a parabaloid dome having a second opening dimensioned to receive the distal end of lamp.

3. The lamp assembly of claim 1 where the trim piece is made at least in part of a thermally conductive material and is thermally coupled to the first LED.

4. The lamp assembly of claim 1 where the trim piece is provided with mounting clips that are pivotably mounted to the trim piece such that the mounting clips rotate to engage the back of a wall or ceiling.

5. The lamp assembly of claim 1 comprising a plurality of clips spaced about the periphery of the distal end of the lamp that engage mating receptacles formed in the trim piece.

6. The lamp assembly of claim 5 where the clips resiliently deform to engage the receptacles.

7. The lamp assembly of claim 1 where the clips are formed as part of a separate clamping ring.

8. The lamp assembly of claim 7 where a clamping ring retains the diffuser lens on the housing.

9. The lamp assembly of claim 1 where the trim piece is provided with a plurality of locking members, the locking members engaging the lamp to secure the lamp to the trim piece.

10. The lamp assembly of claim 9 where the locking members are deformable.

11. The lamp assembly of claim 9 where the locking members are resilient.

12. A lamp comprising:

an LED assembly comprising at least a first LED operable to emit light of at least of a first color, and at least a second LED operable to emit light of at least of a second color;

an enclosure configured so that the light at least of a first color emitted from the first LED is mixed with the light at least of a second color emitted from the second LED in the enclosure, the first color being different than the second color, the enclosure having an internal reflector wall;

a diffuser lens through which the light is emitted from the lamp; and a base coupled to the enclosure, the base containing a power supply for the lamp and comprising an exposed electrical connector configured to be connected to a socket that is separate from the lamp.

13. The lamp of claim 12 wherein the enclosure is thermally coupled to the LED assembly such that the enclosure forms part of a heat sink for the at least first LED and the at least a second LED and is configured such that heat is conducted away from the LED assembly and dissipated to the ambient environment via the enclosure.

14. The lamp of claim 12 wherein the internal reflector wall comprises a plurality of flat faces.

15. The lamp of claim 12 further comprising a heat spreader disposed between the LED assembly and the power supply the heat spreader being thermally coupled to the enclosure.

16. The lamp of claim 12 further comprising a diffuser dome in the enclosure for diffusing the light from the LED assembly before it enters the enclosure.

17. The lamp of claim 12 wherein the internal reflector wall comprises a substantially parabaloid shape.

18. The lamp of claim 12 wherein the at least a second LED emits red/orange light.

19. The lamp of claim 12 wherein the enclosure comprises an aluminum spun housing thermally coupled to the LEDs.

20. The lamp of claim 12 wherein the internal reflector wall is provided with high reflective paint.

21. The lamp of claim 12 wherein the electrical connector is an Edison base.

22. The lamp of claim 12 wherein the at least a first LED emits blue light.

23. The lamp of claim 22 wherein the at least a first LED is packaged in a module to form a blue-shifted yellow LED.

24. The lamp of claim 22 wherein the at least a first LED is packaged in a module to form a blue-shifted LED.

25. The lamp of claim 12 wherein a trim piece is secured to the lamp to form an integral lamp assembly.

26. The lamp of claim 25 wherein the trim piece is formed at least partially of a thermally conductive material and is thermally coupled to the first LED and the second LED.

27. The lamp of claim 25 wherein the lamp includes a clip formed integrally with the lamp, the clip engaging the trim piece such that the trim piece is secured the lamp.

28. The lamp of claim 25 wherein the trim piece comprises a second diffuser lens.

29. The lamp of claim 25 wherein the trim piece defines a receptacle that receives a distal end of the lamp and at least one locking member that engages the lamp such that the trim piece is secured the lamp.

30. The lamp of claim 29 wherein the at least one locking member is movable between a retracted position where the lamp may be inserted into the receptacle and an extended position where the at least one locking member holds the lamp to the trim piece.

31. A lamp comprising:

a LED assembly comprising at least a first LED operable to emit light of at least a first color;

an enclosure having an internal reflector wall and a diffuser lens through which the light is emitted from the lamp;

a trim piece comprising a first opening secured to the enclosure to form an integral lamp assembly where at least some of the light emitted from the lamp passes through the first opening, a plurality of clips spaced about the periphery of the distal end of the lamp that engage mating receptacles formed in the trim piece where the clips resiliently deform to engage the receptacles.

32. A lamp comprising:

a LED assembly comprising at least a first LED operable to emit light of at least a first color;

an enclosure having an internal reflector wall and a diffuser lens through which the light is emitted from the lamp;

a trim piece comprising a first opening secured to the enclosure to form an integral lamp assembly where at least some of the light emitted from the lamp passes through the first opening, a plurality of clips formed as part of a separate clamping ring that engage mating receptacles formed in the trim piece.

33. A lamp comprising:

a LED assembly comprising at least a first LED operable to emit light of at least a first color;

an enclosure having an internal reflector wall and a diffuser lens through which the light is emitted from the lamp;

a trim piece comprising a first opening secured to the enclosure to form an integral lamp assembly where at least some of the light emitted from the lamp passes through the first opening, the trim piece comprising a parabaloid dome having a second opening dimensioned to receive the distal end of lamp.

34. A method of making an LED lamp comprising:

providing at least first LED operable to emit light of a first color and at least a second LED operable to emit light of a second color where the first color is different than the second color;

packaging the first LED and the second LED to produce an LED assembly that emits light of the first color and the second color that can be combined to provide light;

connecting the LED assembly to a power supply located in a base; and installing a color mixing enclosure with an internal reflector wall and a diffuser lens configured so that at least some light emitted by the LED assembly when the first LED and the second LED are energized is mixed in the mixing enclosure and exits the LED lamp from the color mixing enclosure through the diffuser lens; and coupling a base the enclosure, the base comprising an exposed electrical connector configured to be connected to a socket that is separate from the lamp.

35. The method of claim 34 further comprising securing a trim piece to the lamp to make a complete lamp assembly.

* * * * *

UNITED STATES PATENT AND TRADEMARK OFFICE

CERTIFICATE OF CORRECTION

PATENT NO. : 8,899,785 B2
APPLICATION NO. : 13/183067
DATED : December 2, 2014
INVENTOR(S) : Antony Paul Van de Ven It is certified that error appears in the above-identified patent and that said Letters Patent is hereby corrected as shown below:

IN THE CLAIMS:

In column 10, claim 34, change line 15 to:

"providing at least a first LED operable to emit light of a first"

Signed and Sealed this
Thirty-first Day of March, 2015

Michelle K. Lee

Michelle K. Lee
*Director of the United States Patent and Trademark Office*